United States Patent [19]

Hefling

[11] Patent Number: 4,759,339

[45] Date of Patent: Jul. 26, 1988

[54] COMPACT SINGLE BURNER PROPANE CAMPSTOVE

[75] Inventor: Dennis V. Hefling, Wichita, Kans.

[73] Assignee: The Coleman Company, Inc., Wichita, Kans.

[21] Appl. No.: 930,520

[22] Filed: Nov. 14, 1986

[51] Int. Cl.[4] ..... F24C 5/02

[52] U.S. Cl. ..... 126/44; 126/38; 431/344

[58] Field of Search ..... 126/39 R, 39 B, 39 E, 126/42, 43, 44, 38, 50, 40; 431/142, 143, 344, 343; 222/3

[56] References Cited

U.S. PATENT DOCUMENTS

| | | | |
|---|---|---|---|
| 2,538,538 | 1/1951 | Stempel et al. | 126/38 |
| 2,825,325 | 3/1958 | Ross | 126/44 |
| 3,156,379 | 11/1964 | Corlet | 126/44 X |
| 3,574,505 | 4/1971 | Kimball | 431/344 |
| 3,933,146 | 1/1976 | Hastings | 126/38 |
| 4,082,993 | 4/1978 | Oakes | 126/40 X |
| 4,126,117 | 11/1978 | Hastings | 126/44 |
| 4,192,284 | 3/1980 | Vache | 126/38 |
| 4,284,058 | 8/1981 | Lutz | 126/38 X |

*Primary Examiner*—Margaret A. Focarino

[57] ABSTRACT

A single burner propane campstove is adapted to be mounted directly on a disposal propane bottle. The campstove includes a regulator assembly which is connected to the propane bottle. A burner assembly is supported by a reflector bowl, and the reflector bowl is supported at discrete points by a spider support bracket which is attached to the regulator assembly. An insulator pad between the burner assembly and the reflector bowl reduces heat conduction. A wind baffle surrounds the outer periphery of the reflector bowl and the space therefrom.

11 Claims, 3 Drawing Sheets

FIG. 1
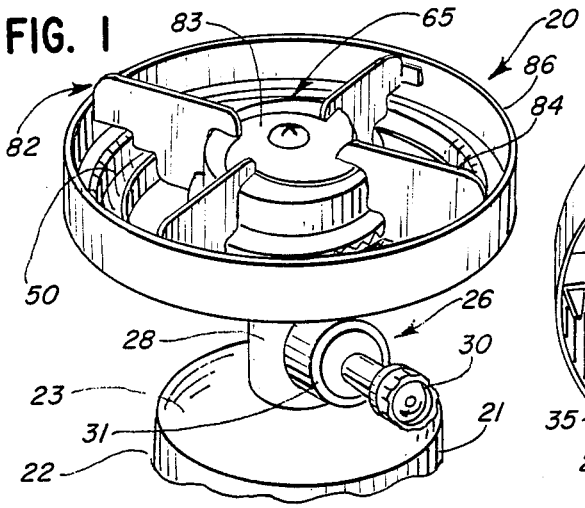
FIG. 2
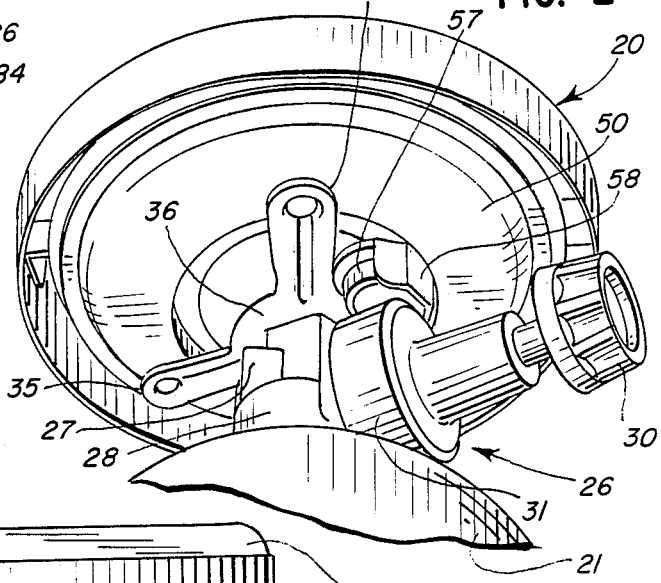
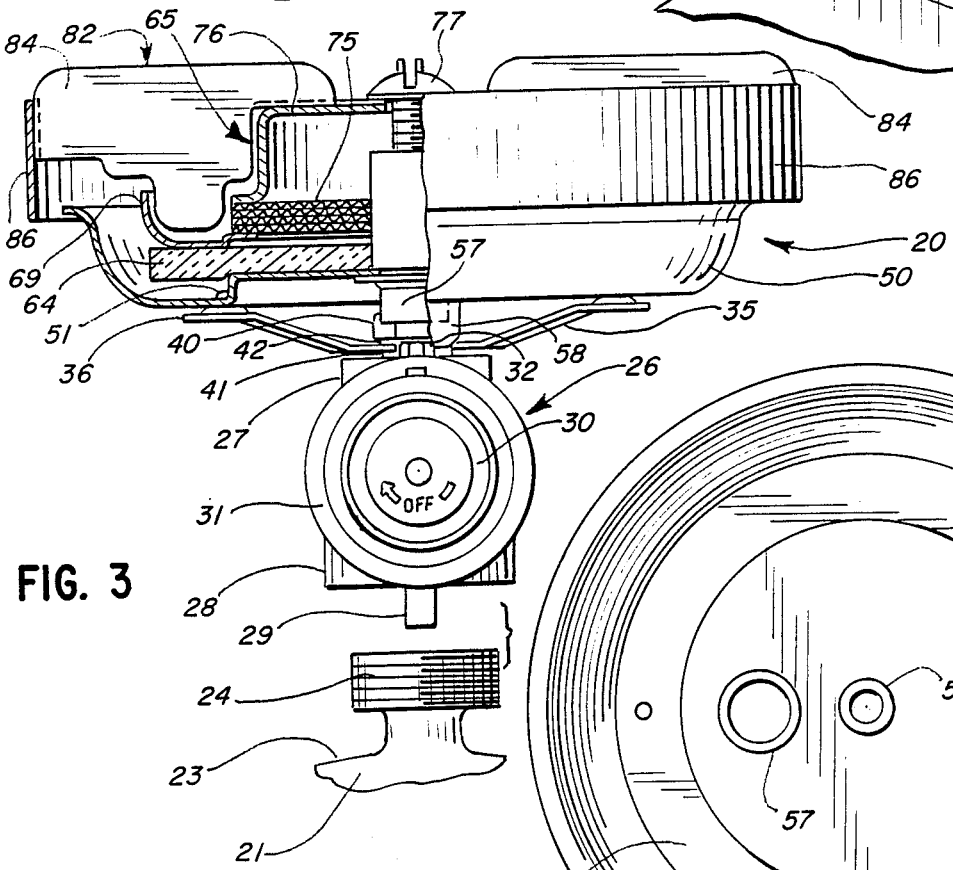
FIG. 3
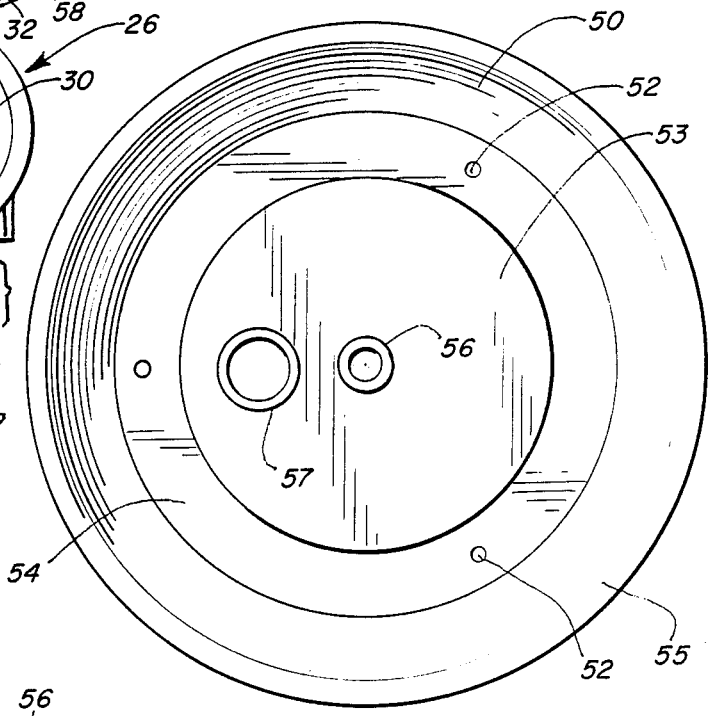
FIG. 5
FIG. 4
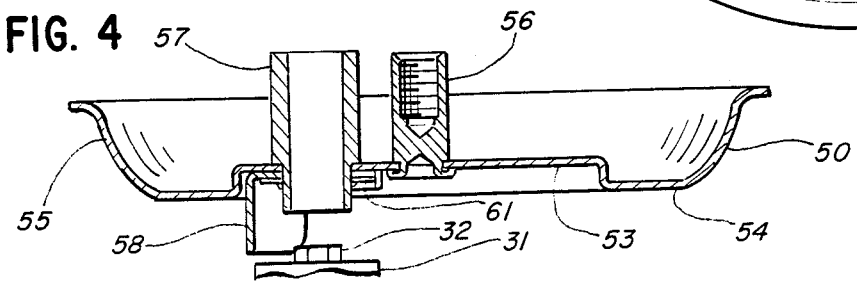

FIG. 13
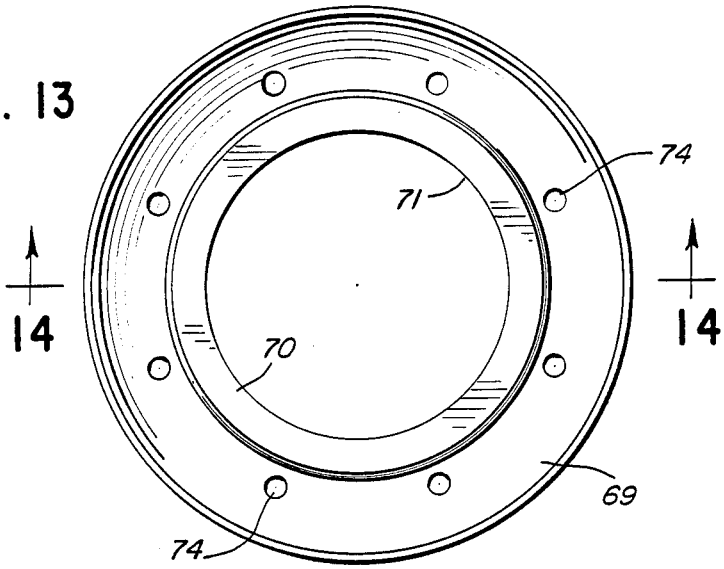
FIG. 14
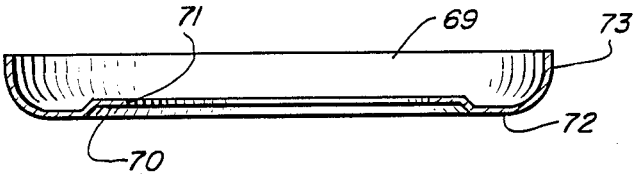
FIG. 15
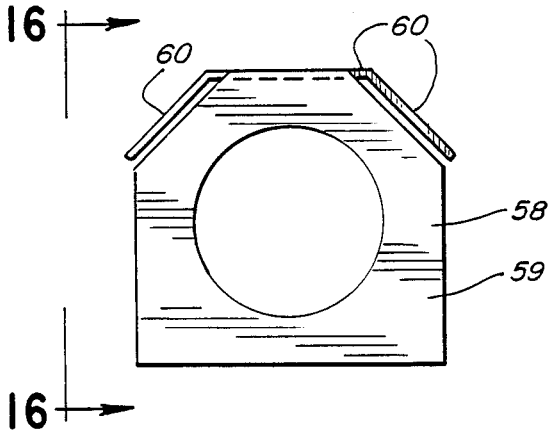
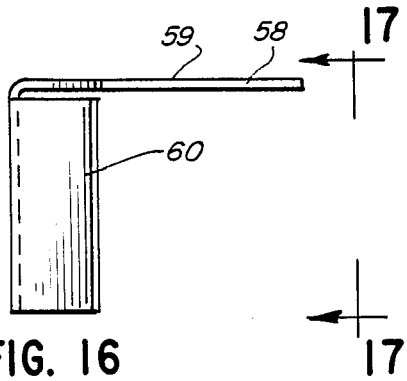
FIG. 16
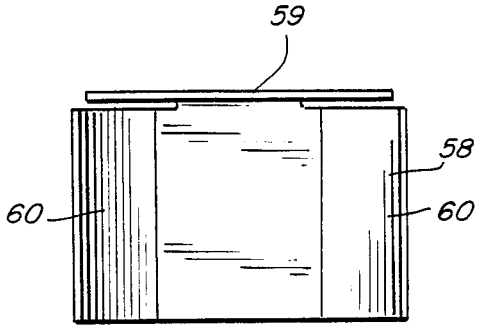
FIG. 17

COMPACT SINGLE BURNER PROPANE CAMPSTOVE

BACKGROUND AND SUMMARY

This invention relates to campstoves, and, more particularly, to a compact campstove which is supported only by a disposable propane bottle.

Campstoves are available which are fueled by liquid fuel or by disposable propane bottles. Lighweight, compact, single burner campstoves are particularly advantageous for backpackers. U.S. Pat. No. 3,933,146 describes a single-burner propane campstove, and U.S. Pat. Re. No. 31,738 describes a single burner liquid fuel campstove.

The invention provides an improved single burner campstove which is lightweight, compact, and inexpensive and which is supported directly on top of a disposable propane bottle. The campstove includes a regulator which is mounted on the propane bottle and a burner assembly which is supported above the regulator. Even though the burner is in close proximity to the regulator, an insulating support system minimizes heat conduction to the regulator. A wind baffle provides protection against wind yet permits air flow around the burner and directs heat to the cooking utensil.

DESCRIPTION OF THE DRAWINGS

The invention will be explained in conjunction with an illustrative embodiment shown in the accompanying drawing, in which FIG. 1 is a fragmentary top perspective view of a campstove in accordance with the invention mounted on a propane bottle;

FIG. 2 is a fragmentary bottom perspective view of the campstove;

FIG. 3 is an exploded fragmentary elevation view, partially broken away, of the campstove and the propane bottle;

FIG. 4 is a sectional view of the reflector bowl assembly;

FIG. 5 is a top plan view of the reflector bowl assembly;

FIG. 13 is a sectional view of the burner bowl;

FIG. 14 is a top plan view of the burner bowl;

FIG. 15 is a top plan view of the wind shield;

FIG. 16 is a side elevational view of the wind shield taken along the line 16—16 of FIG. 15;

FIG. 17 is a side elevational view taken along the line 17—17 of FIG. 16.

DESCRIPTION OF SPECIFIC EMBODIMENT

Figure 6:
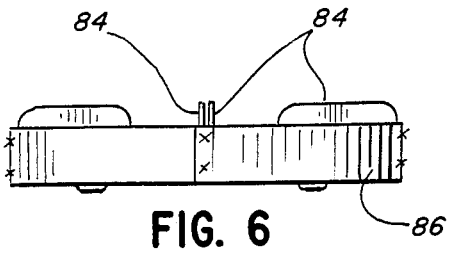
FIG. 6 is a side elevational view of the grate assembly.

Refering to FIGS. 1-3, the numeral 20 designates generally a campstove which is mounted on and supported by a disposable propane bottle or tank 21. The propane bottle 21 is conventional and includes a cylindrical side wall 22, a dome-shaped top 23, and an outlet bushing 24. The outlet bushing is provided with an external screw thread, and a valve is mounted inside of the bushing.

The propane bottle is shown standing in an upright position in which the cylindrical side wall extends vertically. The bottom of the propane bottle may be stabilized by a conventional bottle holder which fits over the bottom of the bottle. The campstove 20 is attached directly to the propane bottle and is supported only by the propane bottle.

The campstove includes a conventional regulator assembly 26 which is used on propane lanterns sold by The Coleman Company, Inc. of Wichita, Kans. The regulator assembly includes a housing 27 which has an internally threaded connector 28 which can be screwed onto the outlet bushing 24. A probe 29 (FIG. 3) extends downwardly from the center of the connector for opening the valve of the propane bottle.

A control knob 30 extends outwardly from a circular bushing 31 on the regulator housing and controls the flow of fuel through the regulator assembly. The fuel exits the regulator assembly through a gas jet or orifice in a bolt 32 (FIGS. 3 and 4) which is screwed into the top of the bushing 31.

Figure 11:
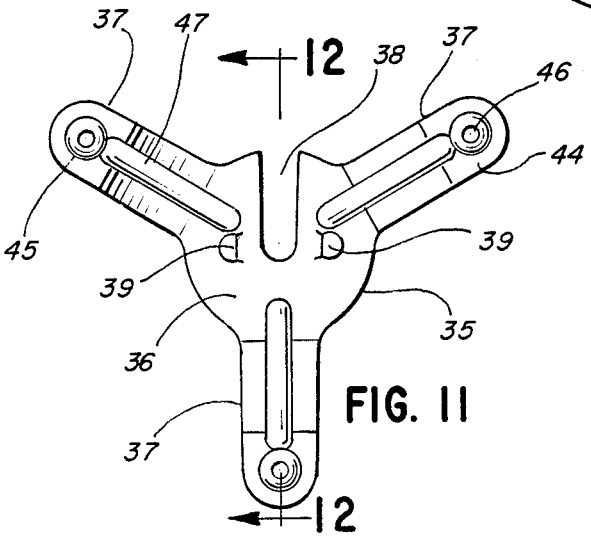
FIG. 11 is a plan view of the spider support brackets.
Figure 12:
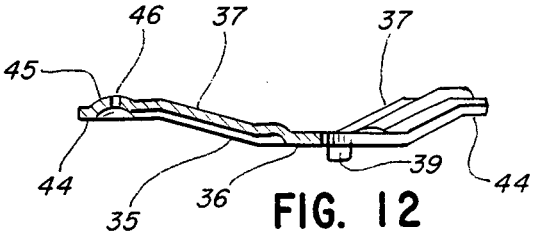
FIG. 12 is a sectional view of the spider support bracket taken along the line 12—12 of FIG. 11.

A three-pronged spider support bracket 35 is attached to the top of the regulator housing 27 directly above the connector 28. Referring to FIGS. 11 and 12, the spider 35 includes a central portion 36 and three outwardly extending arms 37. A slot 38 extends to the center of the central portion, and a pair of tabs 39 are punched downwardly out of the central portion on opposite sides of the slot. The spider is mounted on the regulator housing by a bolt 40 (FIG. 3) which extends through the slot 38 and is screwed into the regulator housing. The tabs 39 contact the top of the regulator housing and minimize contact and heat conduction between the spider and the regulator housing. An insulator washer 41 is positioned between the spider and the regulator housing and between the tabs 39, and an insulator washer 42 is positioned between the spider and the head of the bolt 40.

Referring again to FIGS. 11 and 12, each of the arms 37 of the spider 35 extends slightly upwardly from the central portion 36 and terminates in an end portion 44 which extends parallel to the central portion 36. An upwardly convex dimple or embossment 45 is formed in each end portion, and a rivet hole 46 extends through the center of the dimple. A reinforcing rib 47 is formed in the center of each arm.

A metal reflector bowl 50 is supported by the spider 35 and is attached to the dimples 45 of the spider by rivets 51 (FIG. 3) which extends through holes 52 (FIG. 5) in the reflector bowl. The dimples 45 minimize heat conduction between the reflector bowl and the spider.

The reflector bowl includes a flat central portion 53 (FIGS. 4 and 5), an annular trough 54, and an upwardly and outwardly curved side wall 55. A burner cap mounting stub 56 is attached to the center of the reflector bowl, and a venturi tube 57 extends through the reflector bowl adjacent to stub 56. The bottom of the stub 56 extends through an opening in the reflector bowl and is crimped over the bolt of the bowl. The venturi tube 57 is aligned with the fuel orifice in the bolt 32 of the regulator assembly and is spaced upwardly from the fuel orifice to permit primary combustion air to become aspirated with the fuel as the fuel is injected upwardly into the venturi tube.

The fuel flow between the fuel orifice and the venturi tube is protected by a wind shield 58 (see also FIGS.

15–17). The wind shield includes an attaching portion 59 which is inserted over the bottom of the venturi tube and three side walls 60 which partially surround the venturi tube. The wind shield and the venturi tube are secured to the reflector bowl by a push-on retainer ring 61 which is inserted over the bottom end of the venturi tube. The side of the venturi tube opposite the wind shield is protected from wind by the housing of the regulator assembly.

Figure 10:
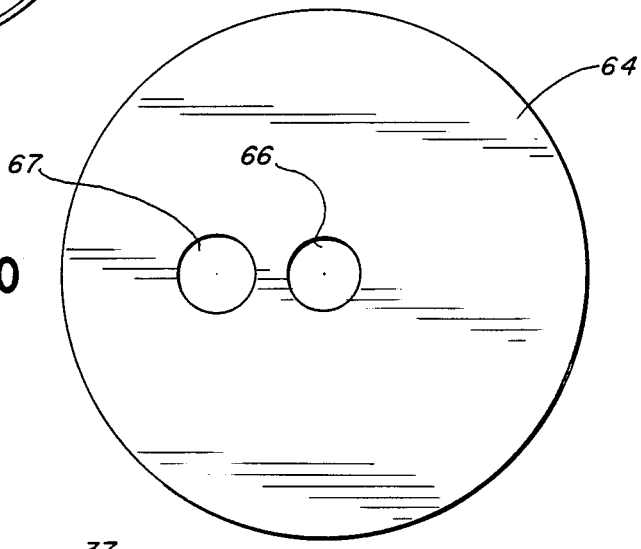
FIG. 10 is a top plan view of the insulator pad.

A circular insulator pad 64 (FIG. 3 and 10) which is formed of insulating material is supported by the central portion 53 of the reflector bowl 50, and a burner assembly 65 is supported on the insulator pad. The insulator pad is provided with openings 66 and 67 (FIG. 10) through which the stub 56 and the venturi tube 57 extend.

A burner assembly 65 includes a burner bowl 69 (FIG. 3, 13, and 14) which is supported by the insulator pad 64. The burner bowl includes a flat annular portion 70 which is provided with a central opening 71, a trough portion 72, and an upwardly curved side wall 73. Eight holes 74 are punched in the trough portion 72.

A plurality of corrugated burner rings 75 are supported by the annular portion 70 of the burner bowl. The burner rings 75 are conventional and are sold by The Coleman Company, Inc. under the trademark Band-A-Blue. Details of the burner rings are described in Patent No. 3,933,146.

Figure 8:
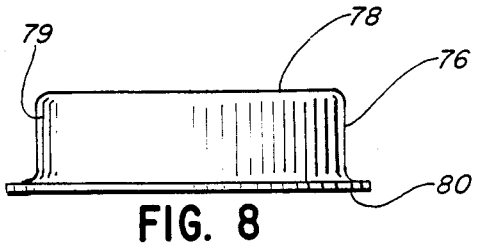
FIG. 8 is a side elevational view of the burner caps.
Figure 9:
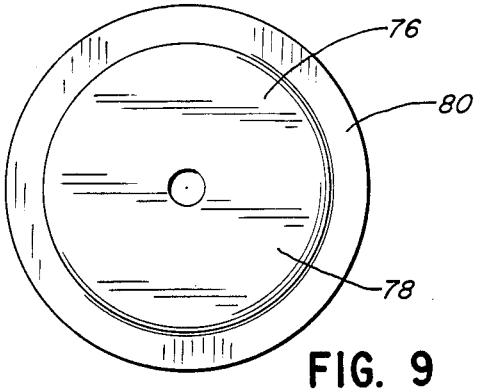
FIG. 9 is a top plan view of the burner cap.

A burner cap 76 is mounted on the burner ring 75 and is secured by a bolt 77 which is screwed into the burner cap retainer stub 56. The burner cap includes a flat top wall 78 (FIGS. 8 and 9), a cylindrical side wall 79, and an outwardly flared bottom flange 80. The burner cap forms a mixing chamber for the fuel and air mixture which flows through the venturi tube 57, and the fuel and air flows through the burner rings and burns outside of the burner rings.

Figure 7:
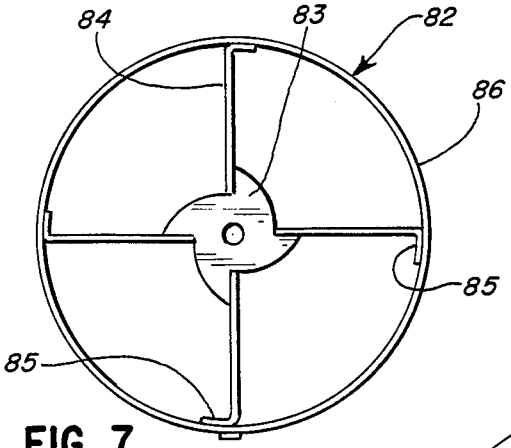
FIG. 7 is a top plan view of the grate assembly.

A grate assembly 82 is supported by the burner cap and is also retained by the bolt 78. The grate assembly includes a flat central portion 83 (FIG. 7), four outwardly extending arms 84 which are welded to the central portion and terminate in perpendicular end flanges 85, and a cylindrical wind baffle 86 which is welded to the end flanges 85. The wind baffle is spaced outwardly from the periphery of the reflector bowl 50, and the bottom edge of the wind baffle extends below the top edge of the reflector bowl.

A cooking utensil such as a frying pan or a pot can be supported by the arms 84 of the grate assembly for heating by the flame which burns around the burner rings 75. The wind baffle 86 protects the flame from wind and directs heat toward the utensil. However, the space between the wind baffle and the reflector bowl allows secondary combustion air to flow freely into the area surrounding the burner rings.

The insulating features of the campstove, including the insulator pad 64, the spider 35, the dimples 45 on the spider, and the insulating washers 41 and 42, permit the burner to be positioned close to the regulator to provide a compact configuration which is lightweight and easy to pack. The campstove is supported solely by the propane bottle 21 and does not require any auxiliary support. The compact configuration of the campstove provides a low center of gravity which increases the stability of the propane bottle and campstove combination.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A propane cooking apparatus which is adapted to be fueled by a propane tank comprising:

(a) a pressure regulator assembly including a threaded connector adapted to be connected to a propane tank, (b) a spider support bracket having a central portion attached to the regulator assembly and a plurality of outwardly extending arms, (c) a reflector bowl attached to the outwardly extending arms of the spider support bracket, said arms of the spider support bracket providing the only connection between the reflector bowl and the regulator assembly, (d) a burner assembly above the reflector bowl, and (e) support means between the reflector bowl and the burner assembly for supporting the burner assembly and for providing insulation between the burner assembly and the reflector bowl.

2. The apparatus of claim 1 in which each of the arms of the spider support bracket includes a convex embossment which engages the reflector bowl in the area of attachment between the arm and the reflector bowl for minimizing heat conduction between the reflector bowl and the arm.

3. The apparatus of claim 1 including a grate assembly mounted on the burner assembly, the grate assembly including a plurality of outwardly extending arms and a cylindrical wind baffle attached to the arms, the cylindrical wind baffle extending around the periphery of the reflector bowl and being spaced therefrom.

4. The campstove of claim 1 in which the regulator assembly includes a gas orifice and the burner assembly includes a venturi tube which is spaced from the gas orifice.

5. The apparatus of claim 1 in which said support means comprises an insulator pad between the reflector bowl and the burner assembly.

6. The apparatus of claim 4 including a windscreen attached to the reflector bowl above the gas orifice and extending downwardly toward the regulator.

7. In combination, a propane tank and a campstove, the propane tank being supported in an upright position and having an external threaded gas outlet bushing, the campstove being supported solely by the propane tank and comprising:

(a) a regulator assembly having an internal threaded connector which is screwed onto the outlet bushing of the propane tank and which provides the only connection between the campstove and the propane tank, (b) a spider support bracket having a central portion attached to the regulator assemby and a plurality of outwardly extending arms, (c) a reflector bowl attached to the outwardly extending arms of the spider support bracket, said arms of the spider support bracket providing the only connection between the reflector bowl and the regulator assembly, (d) a burner assembly above the reflector bowl, and (e) support means between the reflector bowl and the burner assembly for supporting the burner assembly and for providing insulation between the burner assembly and the reflector bowl.

8. The structure of claim 7 in which each of the arms of the spider support bracket includes a convex embossment which engages the reflector bowl in the area of attachment between the arm and the reflector bowl for minimizing heat conduction between the reflector bowl and the arm.

9. The structure of claim 7 including a grate assembly mounted on the burner asembly, the grate assembly including a plurality of outwardly extending arms and a cylindrical wind baffle attached to the arms, the cylindrical wind baffle extending around the periphery of the reflector bowl and being spaced therefrom.

10. The structure of claim 9 in which the regulator assembly includes a gas orifice and the burner assembly includes a venturi tube which is spaced from the gas orifice.

11. The structure of claim 10 in which said support means comprises an insulator pad between the reflector bowl and the burner assembly.

* * * * *

UNITED STATES PATENT AND TRADEMARK OFFICE

CERTIFICATE OF CORRECTION

PATENT NO. : 4,759,339

DATED : July 26, 1988

INVENTOR(S) : Dennis V. Hefling

It is certified that error appears in the above-identified patent and that said Letters Patent is hereby corrected as shown below:

Col. 4, line 47 change "external" to --externally--.

Signed and Sealed this

Twenty-ninth Day of November, 1988

*Attest:*

DONALD J. QUIGG

*Attesting Officer*

*Commissioner of Patents and Trademarks*